US011056053B2

(12) United States Patent
Lee et al.

(10) Patent No.: US 11,056,053 B2
(45) Date of Patent: Jul. 6, 2021

(54) DISPLAY DEVICE AND METHOD OF DRIVING THE SAME

(71) Applicant: Samsung Display Co., Ltd., Yongin-si (KR)

(72) Inventors: Jae Hoon Lee, Yongin-si (KR); Dong Hak Pyo, Yongin-si (KR); Seung Ho Park, Yongin-si (KR); Kyoung Ho Lim, Yongin-si (KR); Sang Myeon Han, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 3 days.

(21) Appl. No.: 16/412,663

(22) Filed: May 15, 2019

(65) Prior Publication Data

US 2020/0058251 A1 Feb. 20, 2020

(30) Foreign Application Priority Data

Aug. 16, 2018 (KR) ..... 10-2018-0095666

(51) Int. Cl.
*G09G 3/3225* (2016.01)
*G09G 3/36* (2006.01)

(52) U.S. Cl.
CPC ..... *G09G 3/3225* (2013.01); *G09G 3/3607* (2013.01); *G09G 2310/0264* (2013.01); *G09G 2310/08* (2013.01); *G09G 2320/0233* (2013.01); *G09G 2320/0242* (2013.01)

(58) Field of Classification Search
CPC ..... G09G 3/3225; G09G 3/3607; G09G 2310/0264; G09G 2310/08; G09G 2320/0233; G09G 2320/0242
USPC ..... 345/76
See application file for complete search history.

(56) References Cited

U.S. PATENT DOCUMENTS

2016/0104429 A1* 4/2016 Kang ..... G09G 3/3291 345/212
2017/0213493 A1* 7/2017 Han ..... G09G 3/3208

FOREIGN PATENT DOCUMENTS

KR 10-2015-0077712 7/2015
KR 10-2017-0088452 8/2017

* cited by examiner

*Primary Examiner* — Chanh D Nguyen
*Assistant Examiner* — Ngan T. Pham-Lu
(74) *Attorney, Agent, or Firm* — H.C. Park & Associates, PLC

(57) ABSTRACT

A display device and a method of driving the same. The display device includes a display panel including a plurality of pixels, a degradation compensator configured to output compensation data based on age values of the plurality of pixels and an input grayscale value of input image data, a scan driver configured to supply a scan signal to the display panel, and a data driver configured to supply a data signal corresponding to the compensation data to the display panel. The degradation compensator includes a first compensation unit configured to generate a first compensation grayscale value with reference to the input grayscale value and a first age value, and a second compensation unit configured to generate a second compensation grayscale value with reference to the first compensation grayscale value and the first age value.

16 Claims, 5 Drawing Sheets

LUT

GR

| | 0 | 1 | 2 | 3 | ··· | G0 | ··· | 256 |
|---|---|---|---|---|---|---|---|---|
| 0 | A0 | B0 | C0 | D0 | ··· | G0 | ··· | E0 |
| 1 | A1 | B1 | C1 | D1 | ··· | G1 | ··· | E1 |
| 2 | A2 | B2 | C2 | D2 | ··· | G2 | ··· | E2 |
| 3 | A3 | B3 | C3 | D3 | ··· | G3 | ··· | E3 |
| ⋮ | ⋮ | ⋮ | ⋮ | ⋮ | ··· | ⋮ | ··· | ⋮ |
| 30 | A30 | B30 | C30 | D30 | ··· | G30 | ··· | E30 |
| ⋮ | ⋮ | ⋮ | ⋮ | ⋮ | ··· | ⋮ | ··· | ⋮ |
| 1023 | A1023 | B1023 | C1023 | D1023 | ··· | G1023 | ··· | E1023 |

AGE

CGR

DISPLAY DEVICE AND METHOD OF DRIVING THE SAME

CROSS-REFERENCE TO RELATED APPLICATION

This application claims priority from and the benefit of Korean patent application number 10-2018-0095666, filed on Aug. 16, 2018, which is hereby incorporated by reference for all purposes as if fully set forth herein.

BACKGROUND

Field

Exemplary embodiments of the present invention relate to a display device and a method of driving the same.

Discussion of the Background

A display device, such as an organic light-emitting display device, accumulates age (e.g., stress or degradation degree) for each pixel using image sticking compensation technology, and eliminates image sticking by compensating for stress for each pixel based on the accumulated age.

For example, such stress may be accumulated based on currents flowing through respective pixels in each frame, the emission times of respective pixels, the temperature of a display panel, and the like.

The above information disclosed in this Background section is only for understanding of the background of the inventive concepts, and, therefore, it may contain information that does not constitute prior art.

SUMMARY

Exemplary embodiments of the present invention are directed to a display device which can display images having uniform luminance by compensating for the degradation of a light-emitting element.

Additional features of the inventive concepts will be set forth in the description which follows, and in part will be apparent from the description, or may be learned by practice of the inventive concepts.

An exemplary embodiment of the present invention provides a display device including a display panel including a plurality of pixels, a degradation compensator configured to output compensation data based on age values of the plurality of pixels and an input grayscale value of input image data, a scan driver configured to supply a scan signal to the display panel, and a data driver configured to supply a data signal corresponding to the compensation data to the display panel. The degradation compensator may include a first compensation unit configured to generate a first compensation grayscale value with reference to the input grayscale value and a first age value, and a second compensation unit configured to generate a second compensation grayscale value with reference to the first compensation grayscale value and the first age value.

The first compensation unit may include a first lookup table in which compensation grayscale values, individually corresponding to a plurality of age values and display grayscale values that are capable of being implemented on the display panel, are set, and the first compensation grayscale value may be determined to be a value mapped to the input grayscale value and to the first age value in the first lookup table.

The first age value may be generated by accumulating pieces of degradation data respectively corresponding to a first frame to a previous frame.

The degradation compensator may further include a degradation data generation unit configured to generate degradation data corresponding to the first compensation grayscale value and configured to generate a second age value based on the generated degradation data and the first age value.

The second age value may be generated by accumulating pieces of degradation data respectively corresponding to the first frame to a current frame.

The second compensation unit may include a second lookup table in which compensation grayscale values, individually corresponding to the plurality of age values and the display grayscale values, are set, and the second compensation grayscale value may be determined to be a value mapped to the first compensation grayscale value and to the first age value in the second lookup table.

The first lookup table may be identical to the second lookup table.

The display device may further include a memory configured to store the second age value.

The memory may be configured to provide the first compensation unit, the degradation data generation unit, and the second compensation unit with the second age value, generated in the previous frame and stored, as a first age value in the current frame.

The degradation compensator may further include an output unit configured to generate the compensation data by applying the second compensation grayscale value to the input image data.

An exemplary embodiment of the present invention provides a method of driving a display device including externally receiving input image data corresponding to a current frame; generating a first compensation grayscale value with reference to an input grayscale value of the input image data, age values of the plurality of pixels, and a first lookup table; generating a second compensation grayscale value with reference to the first compensation grayscale value, the age values, and a second lookup table; and generating compensation data by applying the second compensation grayscale value to the input image data.

Each of the first lookup table and the second lookup table may be configured such that compensation grayscale values, individually corresponding to a plurality of age values and display grayscale values that are capable of being implemented by the plurality of pixels, are set.

Each of the age values may be generated by accumulating pieces of degradation data respectively corresponding to a first frame to a previous frame.

The first lookup table may be identical to the second lookup table.

The method may further include updating the age value with reference to the first compensation grayscale value.

The updated age value may be generated by accumulating pieces of degradation data respectively corresponding to the first frame to the current frame.

The method may further include storing the updated age value in a memory.

The method may further include supplying the compensation data to the plurality of pixels.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
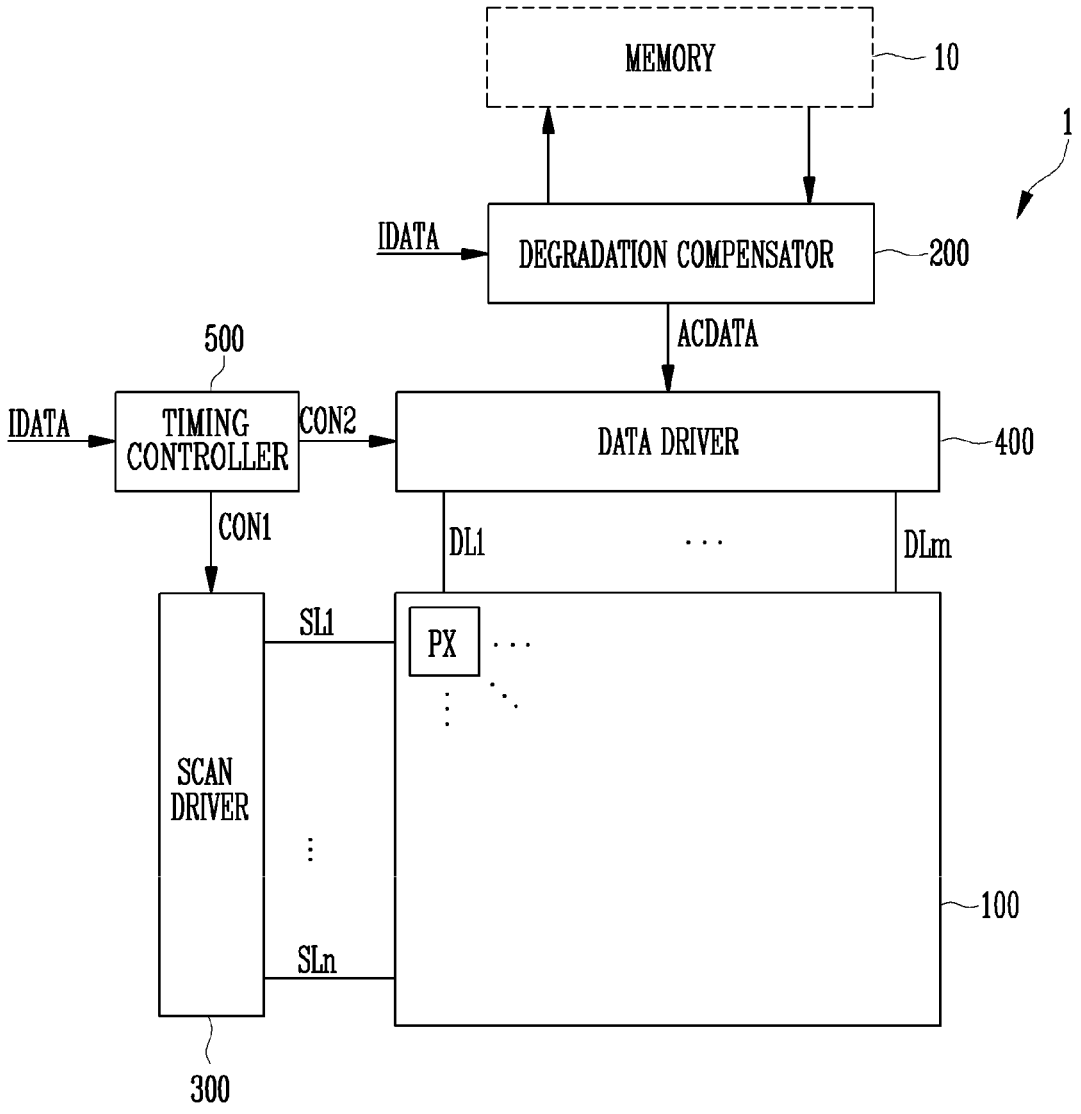
FIG. 1 is a diagram illustrating the configuration of a display device according to an exemplary embodiment of the present invention.

In the following description, for the purposes of explanation, numerous specific details are set forth in order to provide a thorough understanding of various exemplary embodiments of the invention. As used herein "embodiments" are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art. In this specification, "connected/coupled" refers to one component not only directly coupling another component but also indirectly coupling another component through an intermediate component.

As is customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Hereinafter, a display device and a method of driving the display device in accordance with exemplary embodiments of the present invention will be described with reference to the attached drawings.

FIG. 1 is a diagram illustrating the configuration of a display device according to an exemplary embodiment of the present invention.

Referring to FIG. 1, a display device 1 may include a display panel 100, a degradation compensator 200, a scan driver 300, a data driver 400, and a timing controller 500.

The display device 1 may include an organic light-emitting display device, a liquid crystal display device, etc. Further, the display device 1 may include a flexible display device, a rollable display device, a curved display device, a transparent display device, a mirror display device, etc., which are each implemented as an organic light-emitting display device or the like.

The display panel 100 may include a plurality of pixels PX, and may display an image. In detail, the display panel 100 may include a pixel PX coupled to at least one of a plurality of scan lines SL1 to SLn and at least one of a plurality of data lines DL1 to DLm. In an exemplary embodiment, the display panel 100 may provide degradation data (or age data) of pixels, generated by a pixel sensing operation or the like, to the degradation compensator 200.

The degradation data may include emission times, grayscale values, luminance values, temperatures, etc. of the pixels. The degradation data may be generated for each pixel or for each pixel block including grouped pixels.

The degradation compensator 200 may output compensation data ACDATA based on age data and the input grayscale value of input image data IDATA. That is, the degradation compensator 200 may individually determine a compensation value depending on a grayscale value to be displayed by the corresponding pixel PX.

The degradation compensator 200 may calculate degradation data corresponding to each frame with reference to the input image data IDATA. Also, the degradation compensator 200 may calculate age data in which the degradation data is accumulated.

The degradation compensator 200 may calculate compensation grayscale values based on the accumulated age data and the input grayscale values of the input image data IDATA, and may generate compensation data ACDATA by applying the calculated compensation grayscale values to the input image data IDATA.

Although the degradation compensator 200 is illustrated as being a separate component in FIG. 1, the degradation compensator 200 may be included in the timing controller 500 in some cases. Alternatively, the degradation compensator 200 may be included in the data driver 400.

The accumulated age data may be stored in an external memory 10, which may be a flash memory.

The degradation compensator 200 may include a memory having a plurality of lookup tables in which compensation values, which correspond to a plurality of preset age values corresponding to the age data and display grayscale values that can be implemented on the display panel 100, are set.

The scan driver 300 may provide scan signals to the pixels PX of the display panel 100 through the scan lines SL1 to SLn. The scan driver 300 may provide the scan signals to the display panel 100 in response to a first control signal CON1 received from the timing controller 500.

The data driver 400 may provide data signals corresponding to the compensation data ACDATA to the pixels PX of the display panel 100 through the data lines DL1 to DLm. The data driver 400 may provide the data signals to the display panel 100 in response to a second control signal CON2 received from the timing controller 500.

The data driver 400 may include a gamma correction unit (or a gamma voltage generation unit) which converts the compensation data ACDATA into voltages corresponding to the data signals. The compensation data ACDATA in a grayscale domain may be converted into data voltages in a voltage domain by the gamma correction unit.

Alternatively, in some cases, the gamma correction unit may be arranged separately from the data driver 400. For example, the gamma correction unit may receive scaled input grayscale data from a separate grayscale scaling unit, and may convert the scaled input grayscale data into grayscale voltages in a voltage domain. The gamma correction unit may add compensation values to the grayscale voltages in the voltage domain, and then provide the compensation grayscale voltages in the voltage domain to the data driver 400.

The timing controller 500 may be provided with the input image data IDATA from an external graphics source or the like, and may control the driving of the scan driver 300 and the data driver 400.

The timing controller 500 may control the scan driver 300 and the data driver 400 by generating the first and second control signals CON1 and CON2, and providing the first and second control signals CON1 and CON2 to the scan driver 300 and the data driver 400.

In an exemplary embodiment, the input image data IDATA may include input grayscale data, and the timing controller 500 may further control the driving of the degradation compensator 200.

Figures 2, 3:
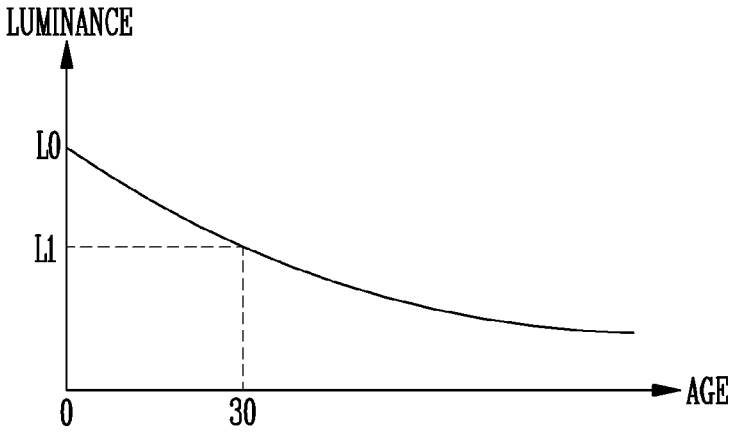
FIG. 2 and FIG. 3 are diagrams schematically illustrating a method of determining a compensation grayscale value corresponding to the age of a pixel.

FIG. 2 and FIG. 3 are diagrams schematically illustrating a method of determining a compensation grayscale value corresponding to the age of a pixel. In particular, FIG. 2 is a graph corresponding to an age-luminance function of the pixel, and FIG. 3 is a diagram illustrating an example of a lookup table LUT including information about the amount of compensation corresponding to the age and grayscale value of the pixel.

The graph illustrated in FIG. 2 may be the age-luminance function of a pixel, calculated when an input grayscale value is a first grayscale value G0, and a graph corresponding to the age-luminance function of the pixel in another input grayscale value may be different from that of FIG. 2.

Referring to FIG. 2, when an input grayscale value corresponding to the first grayscale value G0 is initially inputted (i.e., AGE=0), the pixel may emit light at first luminance L0. However, when the degradation of the pixel progresses (e.g., age changes from AGE=0 to AGE=30), the pixel may emit light at second luminance L1 darker than the first luminance L0 when the input grayscale value corresponding to the first grayscale value G0 is inputted.

The degradation compensator 200 according to the exemplary embodiment may compensate for the input grayscale value using a grayscale value higher than the first grayscale value G0 so that the pixel can emit light at the first luminance L0 corresponding to the first grayscale value G0. Here, compensation grayscale information may be determined with reference to the lookup table, such as that illustrated in FIG. 3.

Referring to FIG. 3, in the lookup table LUT, compensation grayscale values CGR, individually corresponding to a plurality of age values AGE and display grayscale values GR that can be implemented on the display panel, may be set. A case where the compensation grayscale values are generated using the lookup table LUT will be described below by way of example. When an input grayscale value IGR is a first grayscale value G0 and the age value AGE of the pixel is 30, the compensation grayscale value CGR may be a second grayscale value G30 higher than the first grayscale value G0.

That is, the degradation compensator 200 may perform control such that current corresponding to the second grayscale value G30 flows through a light-emitting element included in the pixel which is being degraded in order to cause the age value AGE to be 30, and thus, the pixel may emit light at the first luminance L0 corresponding to the first grayscale value G0.

Figure 4:
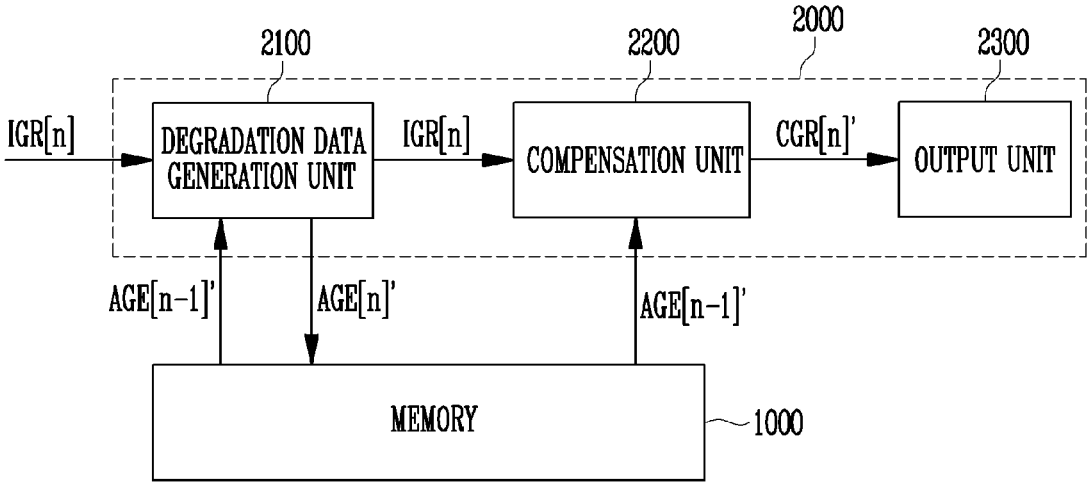
FIG. 4 is a diagram illustrating a conventional degradation compensation method.

FIG. 4 is a diagram illustrating a conventional degradation compensation method. In particular, the configuration of a conventional degradation compensator 2000 is schematically illustrated in FIG. 4.

The conventional degradation compensator 2000 may include a degradation data generation unit 2100, a compensation unit 2200, and an output unit 2300.

The degradation data generation unit 2100 may calculate age values of pixels provided on the display panel. The degradation data generation unit 2100 may calculate degradation data corresponding to an n-th frame (where n is a natural number of 2 or more) using an input grayscale value IGR[n], which is included in input image data corresponding to an image to be displayed in the n-th frame.

The degradation data generation unit 2100 may receive information about a first age value AGE[n−1]', in which pieces of degradation data respectively corresponding to first to n−1-th frames are accumulated, from a memory 1000. The degradation data generation unit 2100 may calculate a second age value AGE[n]' by further accumulating degradation data corresponding to an n-th frame in the first age value AGE[n−1]'. The calculated second age value AGE[n]' may be stored again in the memory 1000.

The compensation unit 2200 may calculate a compensation grayscale value CGR[n]' while the degradation data generation unit 2100 calculates the age values of pixels. In detail, the compensation grayscale value CGR[n]' may be calculated with reference to the input grayscale value IGR [n] and the first age value AGE[n−1]' provided from the memory 1000, and the compensation grayscale value CGR [n]' may be determined using the lookup table LUT, such as that described with reference to FIG. 3.

The output unit 2300 may generate compensation data by applying the compensation grayscale value CGR[n]' to the input image data, and may output the compensation data to the data driver.

Since the degradation compensator 2000, such as that illustrated in FIG. 4, calculates age values of pixels using the input grayscale value IGR[n] included in the input image data, a problem arises in that corrected grayscale information is not reflected in the calculation of compensation grayscale values.

The conventional problem described above with reference to FIGS. 2 to 4 is explained in greater detail below. That is, when an input grayscale value IGR is the first grayscale value G0 and the age value of the pixel is 30, current corresponding to the second grayscale value G30 flows through a light-emitting element included in the pixel. That is, in accordance with the conventional technology, the degree of degradation of the pixel is not reflected in the calculation of degradation data because the current corresponding to the second grayscale value G30 flows through the light-emitting element. Therefore, there is a problem in that it is difficult to accurately calculate the age value of each pixel.

Figure 5:
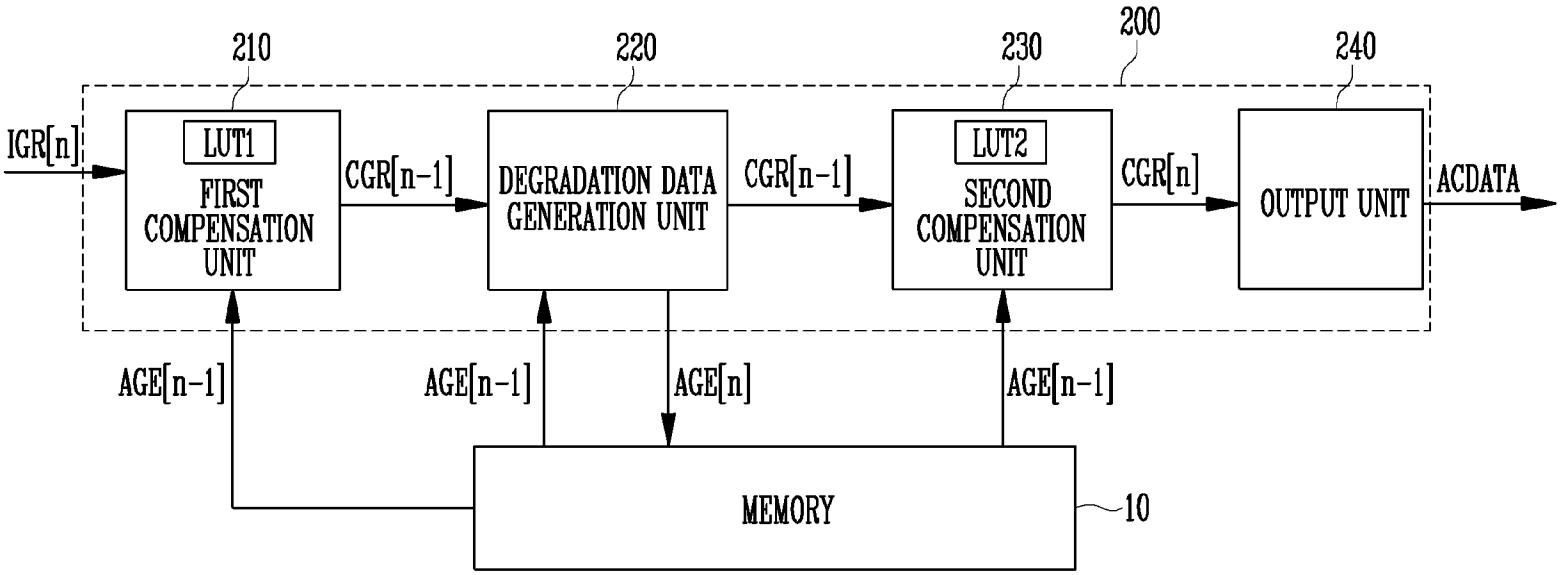
FIG. 5 is a diagram illustrating a degradation compensator of FIG. 1.

FIG. 5 is a diagram illustrating the configuration of the degradation compensator of FIG. 1.

Referring to FIGS. 1 and 5, the degradation compensator 200 according to an embodiment of the present disclosure may include a first compensation unit 210, a degradation data generation unit 220, a second compensation unit 230, and an output unit 240.

The first compensation unit 210 may externally receive input image data IDATA corresponding to an image to be displayed in an n-th frame, and may receive information about a first age value AGE[n−1] from the memory 10. Here, the first age value AGE[n−1] may be calculated by accumulating pieces of degradation data respectively corresponding to a first frame to a previous frame (i.e., n−1-th frame).

The first compensation unit 210 may generate a first compensation grayscale value CGR[n−1] with reference to an input grayscale value IGR[n] included in the input image data IDATA and the first age value AGE[n−1]. In detail, the first compensation grayscale value CGR[n−1] may be determined to be a value mapped to the input grayscale value IGR[n] and to the first age value AGE[n−1] in a first lookup table LUT1.

The first compensation unit 210 may include the first lookup table LUT1 for generating the first compensation grayscale value CGR[n−1]. The first lookup table LUT1 may be a lookup table LUT, such as that illustrated in FIG. 3. That is, the first lookup table LUT1 may include compensation values that are set in accordance with respective display grayscale values. The compensation values that are set in accordance with respective display grayscale values may be different from each other depending on the age values.

The degradation data generation unit 220 may calculate the age values of the pixels PX provided on the display panel 100. For this operation, the degradation data generation unit 220 may receive the first compensation grayscale value CGR[n−1] from the first compensation unit 210, and may receive the first age value AGE[n−1] from the memory 10.

The degradation data generation unit 220 may calculate degradation data corresponding to an n-th frame with reference to the first compensation grayscale value CGR[n−1]. Further, the degradation data generation unit 220 may generate a second age value AGE[n] by accumulating the calculated degradation data to be added to the first age value AGE[n−1].

Here, the second age value AGE[n] may be calculated by accumulating pieces of degradation data respectively corresponding to a first frame to a current frame (i.e., n-th frame).

The second age value AGE[n] generated by the degradation data generation unit 220 may be stored in the memory 10. When input image data IDATA corresponding to a next frame (e.g., n+1-th frame) is inputted, the second age value AGE[n], which is generated in the current frame and is stored in the memory 10, may be supplied to the first compensation unit 210, the degradation data generation unit 220, and the second compensation unit 230.

The second compensation unit 230 may generate a second compensation grayscale value CGR[n] with reference to the first compensation grayscale value CGR[n−1] and the first age value AGE[n−1]. In detail, the second compensation grayscale value CGR[n] may be determined to be a value mapped to the first compensation grayscale value CGR[n−1] and to the first age value AGE[n−1] in a second lookup table LUT2.

The second compensation unit 230 may include the second lookup table LUT2 for generating the second compensation grayscale value CGR[n]. The second lookup table LUT2 may be a lookup table LUT, such as that illustrated in FIG. 3. That is, the second lookup table LUT2 may include compensation values that are set in accordance with respective display grayscale values. The compensation values that are set in accordance with respective display grayscale values may be different from each other depending on the age values. Further, the second lookup table LUT2 may be identical to the first lookup table LUT1.

Although FIG. 5 illustrates the second compensation unit 230 as being provided with the first compensation grayscale value CGR[n−1] through the degradation data generation unit 220, the scope of the inventive concepts is not limited thereto. The second compensation unit 230 may also receive the first compensation grayscale value CGR[n−1] from the first compensation unit 210.

The output unit 240 may generate compensation data ACDATA by incorporating the second compensation grayscale value CGR[n], generated by the second compensation unit 230, into the input image data IDATA. The compensation data ACDATA, generated by the output unit 240, may be supplied to the data driver 400.

Although, in FIG. 5, the first compensation unit 210, the degradation data generation unit 220, the second compensation unit 230, and the output unit 240 are illustrated as being separate components, the scope of the inventive concepts is not limited thereto. For example, the first compensation unit 210, the degradation data generation unit 220, the second compensation unit 230, and the output unit 240 may be integrated into a single component.

Figure 6:
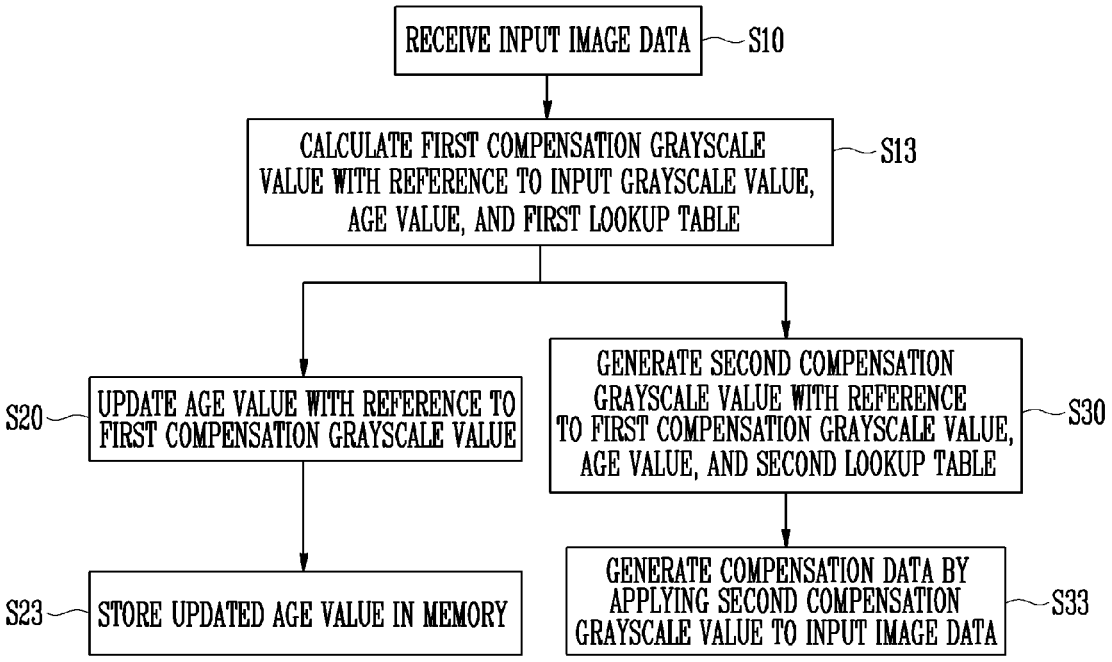
FIG. 6 is a flowchart illustrating the operation of the degradation compensator of FIG. 1.

FIG. 6 is a flowchart illustrating the operation of the degradation compensator of FIG. 1.

Referring to FIGS. 1, 5, and 6, the degradation compensator 200 may externally receive input image data corresponding to a current frame at step S10.

The degradation compensator 200 may generate a first compensation grayscale value CGR[n−1] with reference to an input grayscale value IGR[n] included in the input image data IDATA, an age value AGE[n−1], and a first lookup table LUT1 at step S13. At step S13, the age value AGE[n−1] may be information corresponding to pieces of degradation data accumulated in frames ranging to a previous frame.

The degradation compensator 200 may update the age value with reference to the first compensation grayscale value CGR[n−1] at step S20. In detail, step S20 may be performed by accumulating degradation data, corresponding to the first compensation grayscale value CGR[n−1], to be added to the age value AGE[n−1] corresponding to the degradation data accumulated in frames ranging to the previous frame.

The degradation compensator 200 may store the age value AGE[n], updated at step S20, in the memory 10 at step S23.

The degradation compensator 200 may generate a second compensation grayscale value CGR[n] with reference to the first compensation grayscale value CGR[n−1], the age value AGE[n−1], and a second lookup table LUT2 at step S30. At step S30, the age value AGE[n−1] may be information corresponding to pieces of degradation data accumulated in the frames ranging to the previous frame.

When the second compensation grayscale value CGR[n] is generated, the degradation compensator 200 may generate compensation data ACDATA by applying the second compensation grayscale value CGR[n] to the input image data IDATA at step S33. The compensation data ACDATA, generated by the degradation compensator 200, may be supplied to the data driver 400.

Unlike conventional technology, which generates degradation data using input grayscale values, the degradation compensator 200 according to the inventive concepts generates degradation data using a first compensation grayscale value in which accumulated degradation data is reflected, and thus, the age values of pixels may be more accurately calculated. Therefore, compensation grayscale values for compensating for the degradation of pixels may be precisely calculated.

In accordance with the inventive concepts, images having uniform luminance may be displayed by compensating for the degradation of light-emitting elements.

Further, in accordance with the inventive concepts, degradation data is generated based on grayscale information actually applied to degraded light-emitting elements, and thus, the degree of degradation of the light-emitting elements may be precisely obtained.

Those skilled in the art to which the present disclosure pertains will understand that the present disclosure may be practiced in other detailed forms without departing from the technical spirit or essential features thereof. Therefore, it should be understood that the above-described embodiments are only exemplary in all aspects rather than being restrictive. It is intended that the scope of the present disclosure should be defined by the accompanying claims rather than the above-described descriptions, and various modifications, additions and substitutions, which can be derived from the meaning, scope and equivalent concepts of the accompanying claims, fall within the scope of the present disclosure.

What is claimed is:

1. A display device, comprising:

a display panel comprising a plurality of pixels;

a degradation compensator configured to output compensation data based on age values of the plurality of pixels and an input grayscale value of input image data;

a scan driver configured to supply a scan signal to the display panel; and a data driver configured to supply a data signal corresponding to the compensation data to the display panel, wherein the degradation compensator comprises:

a first compensation unit configured to generate a first compensation grayscale value with reference to the input grayscale value and a first age value;

a degradation data generation unit configured to generate degradation data corresponding to the first compensation grayscale value and configured to generate a second age value based on the generated degradation data and the first age value; and a second compensation unit configured to generate a second compensation grayscale value with reference to the first compensation grayscale value and the first age value, and wherein the input grayscale value, the first compensation grayscale value, and the second compensation grayscale value correspond to different age values, respectively, and corresponds to a same luminance.

2. The display device according to claim 1, wherein:

the first compensation unit comprises a first lookup table in which compensation grayscale values, individually corresponding to a plurality of age values and display grayscale values that are capable of being implemented on the display panel, are set; and the first compensation grayscale value is determined to be a value mapped to the input grayscale value and to the first age value in the first lookup table.

3. The display device according to claim 2, wherein the first age value is generated by accumulating pieces of degradation data respectively corresponding to a first frame to a previous frame.

4. The display device according to claim 3, wherein the second age value is generated by accumulating pieces of degradation data respectively corresponding to the first frame to a current frame.

5. The display device according to claim 4, further comprising a memory configured to store the second age value.

6. The display device according to claim 5, wherein the memory is configured to provide the first compensation unit, the degradation data generation unit, and the second compensation unit with the second age value, generated in the previous frame and stored, as a first age value in the current frame.

7. The display device according to claim 5, wherein the degradation compensator further comprises an output unit configured to generate the compensation data by applying the second compensation grayscale value to the input image data.

8. The display device according to claim 3, wherein:

the second compensation unit comprises a second lookup table in which compensation grayscale values, individually corresponding to the plurality of age values and the display grayscale values, are set; and the second compensation grayscale value is determined to be a value mapped to the first compensation grayscale value and to the first age value in the second lookup table.

9. The display device according to claim 8, wherein the first lookup table is identical to the second lookup table.

10. A method of driving a display device including a plurality of pixels, comprising:

externally receiving input image data corresponding to a current frame;

generating a first compensation grayscale value with reference to an input grayscale value of the input image data, age values of the plurality of pixels, and a first lookup table;

generating degradation data corresponding to the first compensation grayscale value and updating the age values to based on the generated degradation data and the age values;

generating a second compensation grayscale value with reference to the first compensation grayscale value, the age values, and a second lookup table; and generating compensation data by applying the second compensation grayscale value to the input image data, wherein the input grayscale value, the first compensation grayscale value, and the second compensation grayscale value correspond to different age values, respectively, and corresponds to a same luminance.

11. The method according to claim 10, wherein each of the first lookup table and the second lookup table is configured such that compensation grayscale values, individually corresponding to a plurality of age values and display grayscale values that are capable of being implemented by the plurality of pixels, are set.

12. The method according to claim 11, wherein each of the age values is generated by accumulating pieces of degradation data respectively corresponding to a first frame to a previous frame.

13. The method according to claim 11, wherein the first lookup table is identical to the second lookup table.

14. The method according to claim 10, wherein the updated age value is generated by accumulating pieces of degradation data respectively corresponding to the first frame to the current frame.

15. The method according to claim 14, further comprising storing the updated age value in a memory.

16. The method according to claim 10, further comprising supplying the compensation data to the plurality of pixels.

* * * * *